US011808420B2

(12) United States Patent
Li et al.

(10) Patent No.: US 11,808,420 B2
(45) Date of Patent: Nov. 7, 2023

(54) LED VEHICLE LAMP WITH FRUSTUM BASE PLATE

(71) Applicant: SOUTH CHINA UNIVERSITY OF TECHNOLOGY, Guangzhou (CN)

(72) Inventors: Zongtao Li, Guangzhou (CN); Binhai Yu, Guangzhou (CN); Yong Tang, Guangzhou (CN); Caiman Yan, Guangzhou (CN); Cunjiang Song, Guangzhou (CN); Qiliang Zhao, Guangzhou (CN); Longshi Rao, Guangzhou (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 24 days.

(21) Appl. No.: 17/613,855

(22) PCT Filed: Jul. 2, 2020

(86) PCT No.: PCT/CN2020/099927
§ 371 (c)(1),
(2) Date: Nov. 23, 2021

(87) PCT Pub. No.: WO2021/000916
PCT Pub. Date: Jan. 7, 2021

(65) Prior Publication Data

US 2022/0316674 A1 Oct. 6, 2022

(30) Foreign Application Priority Data

Jul. 3, 2019 (CN) ..... 201910592162.1

(51) Int. Cl.
*F21S 41/151* (2018.01)
*F21S 45/40* (2018.01)
(Continued)

(52) U.S. Cl.
CPC ..... *F21S 41/151* (2018.01); *F21S 41/148* (2018.01); *F21S 41/176* (2018.01); *F21S 45/40* (2018.01); *F21S 45/47* (2018.01); *F21Y 2107/90* (2016.08)

(58) Field of Classification Search
CPC ..... F21S 41/141; F21S 41/148; F21S 45/40; F21S 41/176; F21S 43/14; F21S 45/47;
(Continued)

(56) References Cited

U.S. PATENT DOCUMENTS

2011/0156067 A1* 6/2011 Lin ..... F21S 4/20 257/E33.005
2014/0092621 A1* 4/2014 Freund ..... G02B 6/0006 362/555
(Continued)

FOREIGN PATENT DOCUMENTS

CH 103507881 A 1/2014
CN 102185042 A 9/2011
(Continued)

OTHER PUBLICATIONS

International Search Report for PCT/CN2020/099927, dated Sep. 29, 2020 (English Translation).

*Primary Examiner* — William N Harris
(74) *Attorney, Agent, or Firm* — Troutman Pepper Hamilton Sanders LLP (Rochester)

(57) ABSTRACT

The present disclosure relates to an LED vehicle lamp with a frustum base plate. The LED vehicle lamp includes a base plate, a circuit board and a plurality of LED chips. The base plate is a frustum base plate. The frustum base plate is arranged on an axis of the LED vehicle lamp. A width of an upper bottom surface of the frustum base plate is smaller than that of a lower bottom surface of the frustum base plate. An axis of the circuit board is parallel to an axis of the frustum base plate. A width of the circuit board is smaller
(Continued)

than that of the upper bottom surface of the frustum base plate. The circuit board is installed on the upper bottom surface of the frustum base plate, and the plurality of LED chips are installed on the circuit board.

8 Claims, 5 Drawing Sheets

(51) Int. Cl.
*F21S 41/148* (2018.01)
*F21S 41/176* (2018.01)
*F21S 45/47* (2018.01)
*F21Y 107/90* (2016.01)

(58) Field of Classification Search
CPC ..... F21S 45/42; F21S 41/151; F21S 43/15; F21Y 2107/90
See application file for complete search history.

(56) References Cited

U.S. PATENT DOCUMENTS

| | | | | |
|---|---|---|---|---|
| 2014/0197441 | A1* | 7/2014 | Ye et al. | F21V 23/06 257/98 |
| 2022/0065417 | A1* | 3/2022 | Park | F21S 43/31 |

FOREIGN PATENT DOCUMENTS

| | | | | |
|---|---|---|---|---|
| CN | 110277482 | A | 9/2019 | |
| CN | 209929343 | U | 1/2020 | |
| EP | 3421874 | A1 * | 1/2019 | F21S 41/141 |
| JP | 2015163715 | A | 9/2015 | |

* cited by examiner

LED VEHICLE LAMP WITH FRUSTUM BASE PLATE

CROSS REFERENCE TO RELATED APPLICATIONS

This patent application is a national stage application of International Patent Application No. PCT/CN2020/099927, filed on Jul. 2, 2020, which claims priority of Chinese Patent Application No. 201910592162.1 filed on Jul. 3, 2019, both of which are incorporated by reference herein in their entirety as part of the present application.

TECHNICAL FIELD

The present disclosure relates to the field of automotive illumination, and particularly relates to an LED vehicle lamp with a frustum base plate.

BACKGROUND ART

Along with the development of illumination technology, the LED lamp rapidly replace traditional lamps with the advantages of low power consumption, long service life, high brightness, low heat, environmental protection and the like to become a modern illumination tool with the widest global application range. At present, LED lamps are already popularized and applied to the vehicle industry, and various LED vehicle lamps in the market are infinite.

According to traditional LED vehicle lamp, a cuboid base plate is arranged at an installation position of the vehicle lamp. An axis of the cuboid base plate is perpendicular to an irradiation direction of the vehicle lamp. A circuit board is installed on an upper surface of the cuboid substrate. LED lamp bead includes a plurality of LED chips and a substrate on a back of each LED chip, and the plurality of LED chips are attached to the circuit board in a single-face mode.

The following technical problems frequently exist: light emitted by the LED chips to the lower side of the cuboid base plate is easily blocked by an upper surface of the cuboid base plate and cannot be emitted to the lateral space below the cuboid base plate, so that the illumination range of the LED chips is reduced, the distribution of emitted light is not uniform enough, and the overall illumination effect of the LED vehicle lamp is affected.

SUMMARY

Aiming at the technical problems existing in the prior art, the present disclosure aims to provide an LED vehicle lamp with a frustum base plate. Light emitted by LED chips to the lower side of the frustum base plate will not be blocked by the frustum base plate and can be emitted to the lateral space below the frustum base plate. The illumination range of the LED chips is larger, the distribution of emitted light is more uniform, and the overall illumination effect of the LED vehicle lamp is better.

In order to achieve the above purpose, the present disclosure adopts the following technical schemes:

The LED vehicle lamp with a frustum base plate comprises a base plate, a circuit board and multiple LED chips. The base plate is a frustum base plate, the frustum base plate is arranged on an axis of the LED vehicle lamp, a width of an upper bottom surface of the frustum base plate is smaller than that of a lower bottom surface of the frustum base plate, an axis of the circuit board is parallel to an axis of the frustum base plate, a width of the circuit board is smaller than that of the upper bottom surface of the frustum base plate, the circuit board is installed on the upper bottom surface of the frustum base plate, and the multiple LED chips are installed on the circuit board.

In some embodiments, the circuit board may include a first circuit board and a second circuit board. The first circuit board may be installed on the upper bottom surface of the frustum base plate. The second circuit board may be installed on the lower bottom surface of the frustum base plate. The multiple LED chips may include multiple first LED chips and multiple second LED chips. The multiple first LED chips may be installed on the first circuit board in an inverted mode. A first transparent substrate may be arranged on a back of each the first LED chip. A first phosphor may be arranged on the first substrate, meanwhile the first LED chip and the first substrate may be coated with the first phosphor. The multiple second LED chips may be installed on the second circuit board in an inverted mode. A second transparent substrate may be arranged on a back of each the second LED chip. A second phosphor may be arranged on the second substrate, meanwhile the second LED chip and the second substrate may be coated with the second phosphor.

In some embodiments, the first phosphor may include a first fluorescent glue. Lateral parts of the first LED chip and the first substrate may be coated with the first fluorescent glue. The second phosphor may include a second fluorescent glue, and lateral parts of the second LED chip and the second substrate may be coated with the second fluorescent glue.

In some embodiments, the first phosphor may include a first fluorescent glue lens and a first fluorescent glue. The first substrate may be coated with the first fluorescent glue, and lateral parts of the first LED chip and the first fluorescent glue may be coated with the first fluorescent glue lens. The second phosphor may include a second fluorescent glue and a second fluorescent glue lens. The second substrate may be coated with the second fluorescent glue, lateral parts of the second LED chip and the second fluorescent glue may be coated with the second fluorescent glue lens. Both the first fluorescent glue lens and the second fluorescent glue lens may be of spherical structures.

In some embodiments, the first phosphor may include a first fluorescent glue lens, and lateral parts of the first LED chip and the first substrate may be coated with the first fluorescent glue lens. The second phosphor may include a second fluorescent glue lens, lateral parts of the second LED chip and the second substrate may be coated with the second fluorescent glue lens. Both the first fluorescent glue lens and the second fluorescent glue lens may be of spherical structures.

In some embodiments, a clamping position may be arranged on an upper part of the frustum base plate. The first fluorescent glue lens may be provided with a clamp, and the clamping position may be matched with the clamp to connect the first fluorescent glue lens and the frustum base plate.

In some embodiments, an included angle alpha between a side surface of the frustum base plate and the lower bottom surface of the frustum base plate may be larger than or equal to 25 degrees and smaller than or equal to 75 degrees.

In some embodiments, both the first substrate and the second substrate may be sapphire substrates or silicon carbide substrates, and the frustum base plate may be made of a high-thermal-conductivity base material.

In some embodiments, the axis of the frustum base plate may coincide with the axis of the LED vehicle lamp, and the multiple LED chips may be installed on the circuit board in a single row.

In some embodiments, one end of the frustum base plate may be connected with a radiator. The radiator may be arranged on one side of each the LED chip, and a fan may be arranged on one side of the radiator.

On the whole, the embodiments have the following advantages:

The width of the upper bottom surface of the frustum base plate is smaller than that of the lower bottom surface of the frustum base plate. The width of the circuit board is smaller than that of the upper bottom surface of the frustum base plate. The circuit board is installed on the upper bottom surface of the frustum base plate, and the plurality of LED chips are installed on the circuit board. Therefore, light emitted by the LED chips towards the lower side of the frustum base plate will not be blocked by the frustum base plate and can be emitted to the lateral space below the frustum base plate. The illumination range of the LED chips is larger, the distribution of emitted light is more uniform, and the overall illumination effect of the LED car light is better.

REFERENCE CHARACTERS IN FIG. 1 TO FIG. 7

11 frustum base plate; 111 upper bottom surface; 112 lower bottom surface; 113 clamping position; 12 first circuit board; 131 first LED chip; 132 first fluorescent glue; 133 first fluorescent glue lens; 134 first substrate; 135 lateral part of first LED chip; 136 clamp; 14 second circuit board; 151 second LED chip; 152 second fluorescent glue; 153 second fluorescent glue lens; 154 second substrate; 155 lateral part of second LED chip; 16 radiator; 2 cuboid substrate; 21 substrate LED chip; and 22 chip fluorescent glue.

DETAILED DESCRIPTION OF THE EMBODIMENTS

Figure 1:
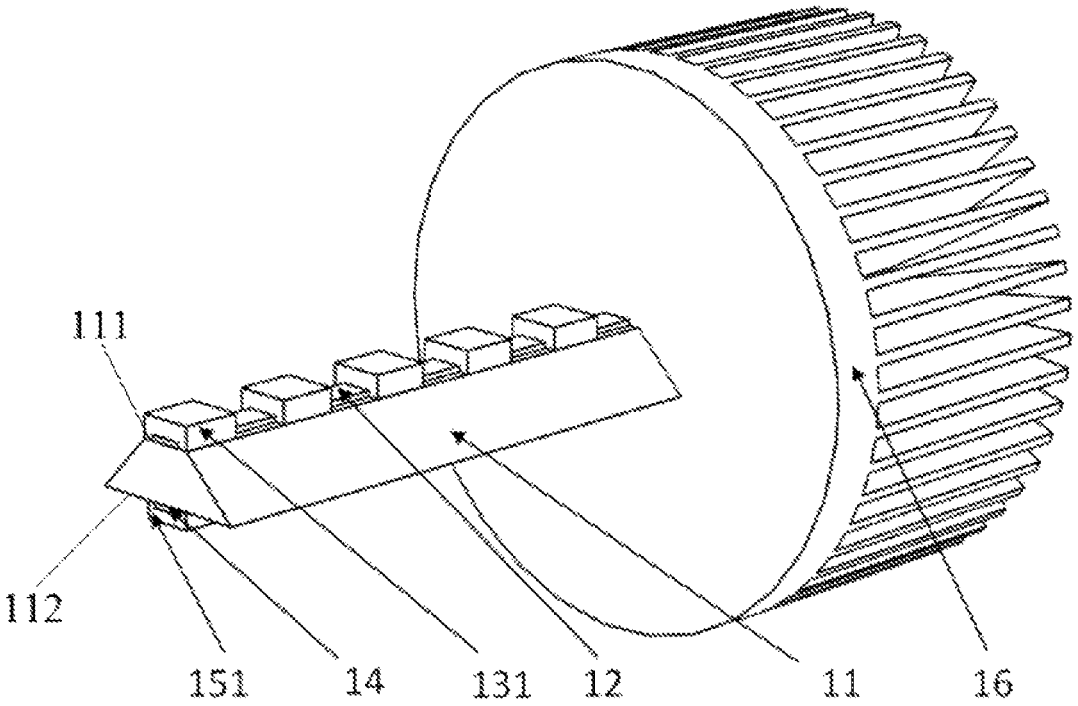
FIG. 1 is a schematic structural diagram of a first embodiment according to the present disclosure, observed in a perspective view.
Figure 2:
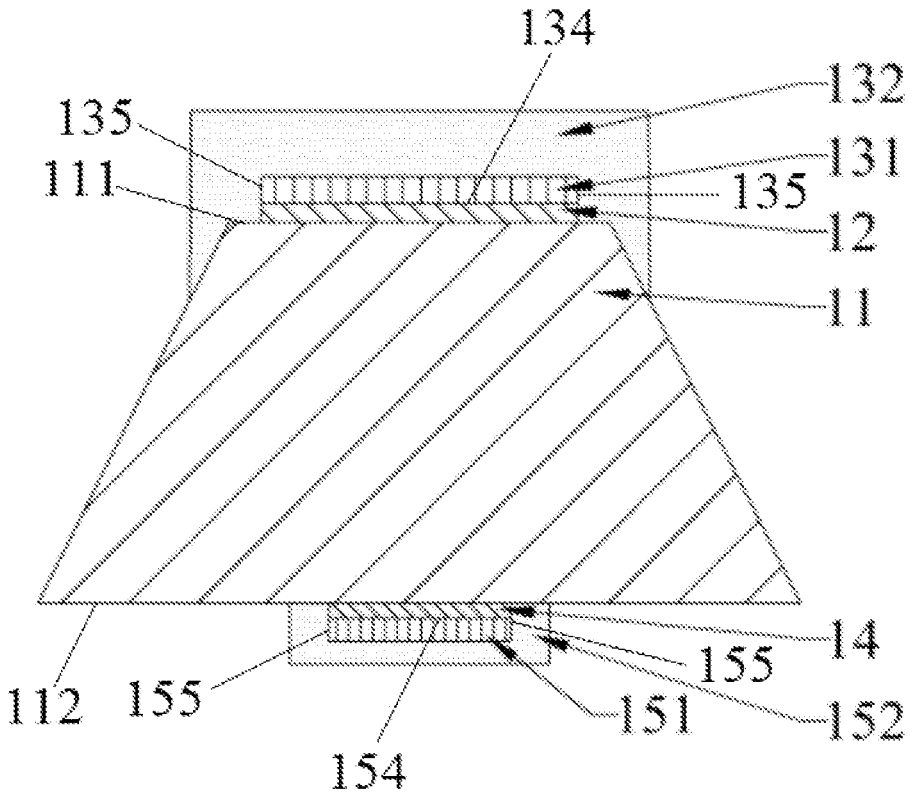
FIG. 2 is a schematic structural diagram of the first embodiment according to the present disclosure, observed in a planer view.
Figure 3:
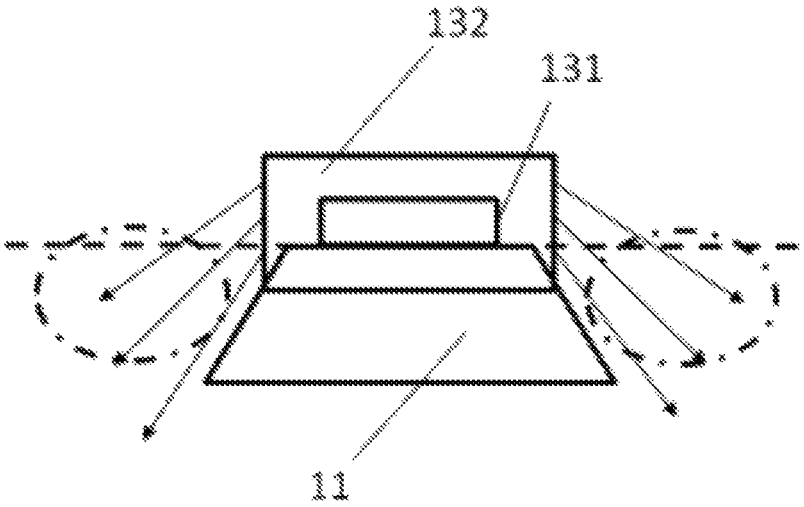
FIG. 3 is a schematic diagram of the first embodiment according to the present disclosure.

Referring to FIG. 1, FIG. 2 and FIG. 3, the present disclosure is described in detail further below.

Embodiment I

As shown in FIG. 1 to FIG. 2, an LED vehicle lamp with a frustum base plate includes a base plate, a circuit board and a plurality of LED chips. The base plate is a frustum base plate 11, which is arranged on the axis of the LED vehicle lamp. A width of an upper bottom surface 111 of the frustum base plate 11 is smaller than that of a lower bottom surface 112 of the frustum base plate. An axis of the circuit board is parallel to the axis of the frustum base plate 11. The width of the circuit board is smaller than that of the upper bottom surface 111 of the frustum base plate 11. The circuit board is installed (such as welded) on the upper bottom surface 111 of the frustum base plate 11 (namely a top surface of the frustum base plate 11). The plurality of LED chips are installed on the circuit board. In the embodiment, the width of the upper bottom surface 111 of the frustum base plate 11 is 1 mm larger than that of the circuit board. The circuit board is a high-thermal-conductivity circuit board.

Figure 7:
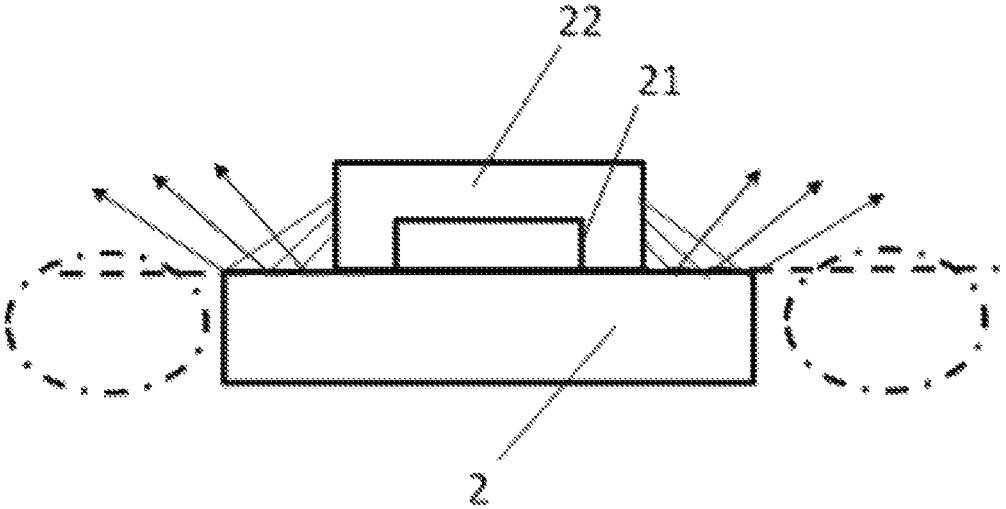
FIG. 7 is a schematic diagram of an LED vehicle lamp with a cuboid substrate in the prior art.

In the prior art, as shown in FIG. 7 by arrows, light emitted from a base plate LED chips 21 to a lower side of a cuboid base plate 2 is easily blocked by an upper surface of the cuboid substrate 2 after passing through a chip fluorescent glue 22 and cannot be emitted to the lateral space below the cuboid base plate 2, such as a space position shown by a circle in the figure. The illumination range of the base plate LED chips 21 is reduced, the distribution of emitted light is not uniform enough, and the overall illumination effect of the LED vehicle lamp is affected.

In the embodiment, due to the fact that the upper bottom surface 111 of the frustum base plate 11 is smaller than the lower bottom surface 112 of the frustum base plate 11, as shown in FIG. 3 by arrows, light emitted by the LED chip towards the lower side of the frustum base plate 11 can penetrate through the narrow upper bottom surface 111 of the frustum base plate 11 slantly and downwards, cannot be blocked by the frustum base plate 11 and can be emitted to the lateral space below the frustum base plate 11, such as the space position shown by a circle in the figure. The illumination range of the LED chips is larger, the distribution of emitted light is relatively more uniform, and the overall illumination effect of the LED vehicle lamp is better.

The circuit board includes a first circuit board 12 and a second circuit board 14. The first circuit board 12 is installed on the upper bottom surface 111 of the frustum base plate 11, the second circuit board 14 is installed on the lower bottom surface 112 of the frustum base plate 11. The plurality of LED chips include a plurality of first LED chips 131 and a plurality of second LED chips 151. The first LED chips 131 are respectively installed on the first circuit board 12 in an inverted mode. A first transparent substrate is arranged on a back of the first LED chip 131. A first phosphor is arranged on the first substrate 134, and the first LED chip 131 and the first substrate 134 are coated with the first phosphor. The plurality of second LED chips 151 are respectively installed on the second circuit board 14 in an inverted mode. A second transparent substrate is arranged on the back of the second LED chip 151. A second phosphor is arranged on the second substrate 154, and the second LED chip 151 and the second substrate 154 are coated with the second phosphor.

In the embodiment, the first LED chip 131 on the upper bottom surface 111 of the frustum base plate 11 is a main light source of the LED vehicle lamp, and the second LED chip 151 on the lower bottom surface 112 of the frustum base plate 11 is a secondary light source of the LED vehicle lamp. When the LED vehicle lamp works, the luminance of the secondary light source is smaller than that of the main light source.

LED lamp beads usually include the LED chips and the substrate. According to the embodiment, an LED chip inversion mode is adopted, namely, the first LED chip 131 is attached to the first circuit board 12 with the electrode facing downwards and the first substrate 134 facing upwards, the second LED chip 151 is attached to the second circuit board 14 with the electrode facing upwards and the second substrate 154 facing downwards. The light emitted by the LED chips can reach a wider space range through the transparent substrate, so that the backward light emitting capacity of the LED chips is further enhanced. The LED chips are respectively attached to the upper bottom surface 111 and the lower bottom surface 112 of the frustum base plate 11, so that the light at the bottom of the frustum base plate 11 are effectively supplemented, and the LED vehicle lamp has an obvious cut-off line and is better in illumination effect.

The first phosphor includes a first fluorescent glue 132. The lateral part 135 of the first LED chip 131 and the first substrate 134 are coated with the first fluorescent glue 132. The second phosphor includes second fluorescent glue 152, and the lateral part 155 of the second LED chip 151 and the second substrate 154 are coated with the second fluorescent glue 152.

In the embodiment, the first fluorescent glue 132 is sprayed on the top surface and the side surface of the first LED chip 131, and the width of the first fluorescent glue 132 is slightly larger than that of the first circuit board 12. Specifically, the top of the frustum base plate 11 is coated with the first fluorescent glue 132, and the color temperature is 5500 K after white light packaging. The second fluorescent glue 152 is sprayed on the bottom surface and the side surface of the second LED chip 151, and the width of the second fluorescent glue 152 is slightly larger than that of the second circuit board 14. Specifically, the second circuit board 14 is coated with the second fluorescent glue 152, and the color temperature is 6500 K after white light packaging. Through the arrangement, light in various directions of the LED chips can be consistent in term of optical path in the fluorescent glue layer, good spatial color uniformity is achieved, and LED color temperatures obtained in various directions are as close as possible.

A taper angle of the frustum base plate 11, namely an included angle alpha between the side surface of the frustum base plate 11 and the lower bottom surface 112 of the frustum base plate 11, is larger than or equal to 25 degrees and smaller than or equal to 75 degrees. Backward light emission of a top LED chip is mainly affected by the taper angle of the frustum base plate 11. The increase of the taper angle is beneficial to strengthening the backward light emitting capacity. In the embodiment of the present disclosure, the taper angle alpha is 45 degrees.

Both the first substrate 134 and the second substrate 154 are sapphire substrates or silicon carbide substrates, and the frustum base plate 11 is made of a high-thermal-conductivity base material.

Most of traditional LED vehicle lamp substrates are aluminum substrates, the thermal conductivity coefficient of aluminum alloy is only 200 W/(m·K). In practical application, due to the fact that the thickness and the thermal conductivity coefficient of the aluminum alloy in contact with a light source are low, a temperature difference between the temperature of the light source and a radiator 16 is large. The temperature difference is generally 40 celsius degrees to 70 celsius degrees, heat cannot be well conducted, and therefore the using effect and the service life time of the LED vehicle lamp are affected. In the embodiment, the high-thermal-conductivity base material is copper, and the frustum base plate 11 is made of a pure copper base material. The thermal conductivity coefficient of the copper is about 400 W/(m·K). The copper has better heat transfer performance, and the heat can be well conducted, so that the service life time of the LED vehicle lamp is prolonged.

The axis of the frustum base plate 11 coincides with the axis of the LED vehicle lamp, namely the axis of the frustum base plate 11 coincides with the irradiation direction of the LED vehicle lamp, the axis of the circuit board coincides with the axis of the frustum base plate 11, and the plurality of LED chips are installed on the circuit board at intervals in a single row.

In the prior art, the axis of the cuboid base plate 2 is perpendicular to the irradiation direction of the vehicle lamp. The circuit board is installed on the upper surface of the cuboid base plate 2. The plurality of substrate LED chips 21 are attached to the circuit board in a single-face mode. Due to the fact that the positions of the substrate LED chips 21 on the cuboid base plate 2 are different, light emitted to the front of the vehicle cannot form light beams on the same straight line, so that the focusing effect of the vehicle lamp is poor. Even if the thickness of the base plate is reduced, light source central points of the base plate LED chips 21 cannot be located in the center of the LED vehicle lamp. If the thickness of the base plate is reduced, the heat dissipation effect of the LED vehicle lamp can be greatly reduced.

According to the embodiment, the axis of the frustum base plate 11 coincides with the axis of the LED vehicle lamp, the axis of the circuit board coincides with the axis of the frustum base plate 11, and the plurality of LED chips are installed on the circuit board in a single row, so that the defect that light cannot be accurately controlled due to the fact that the LED vehicle lamp in the prior art cannot realize the coincidence of the center of the LED chip light source and the focus of the LED vehicle lamp is overcome. Therefore, the central points of LED chip light sources are located on the axis of the LED vehicle lamp. Light emitted to the front of the vehicle from the LED chip light sources form light beams on the same straight line. The focusing effect of the vehicle lamp is good, and the LED vehicle lamp has an obvious cut-off line.

One end of the frustum base plate 11 is connected with the radiator 16, which is arranged on one side of the LED chip, so that the heat generated by the LED chip is rapidly transmitted to the radiator 16 through the frustum base plate 11. A fan is arranged on one side of the radiator 16 so as to enhance the heat dissipation effect. In the embodiment of the present disclosure, the radiator 16 is made of the pure copper base material.

Embodiment II

Figure 4:
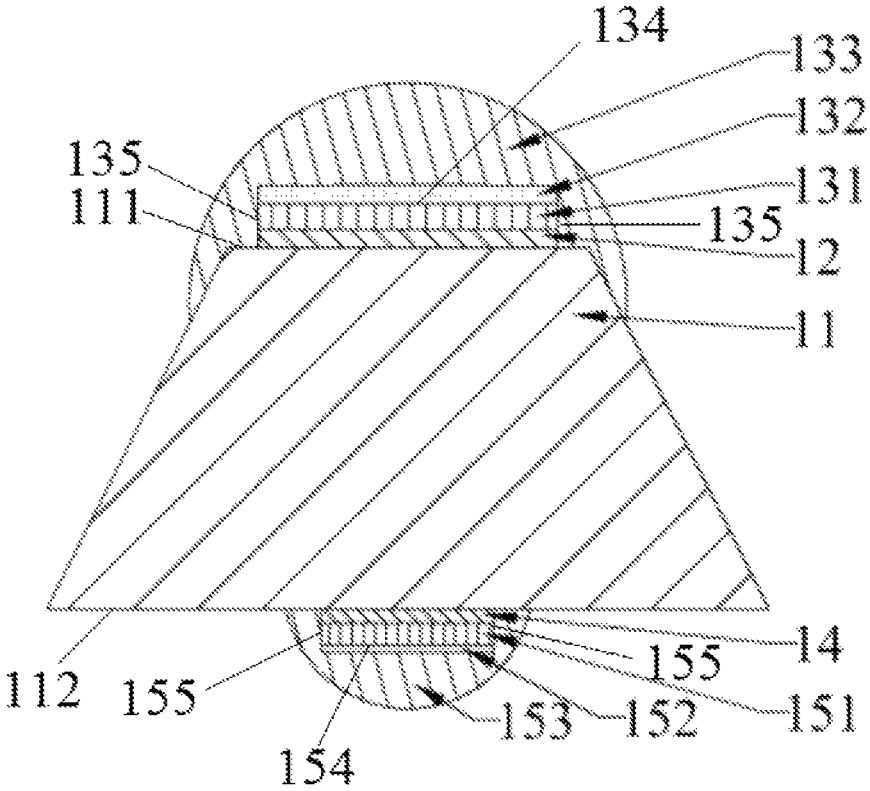
FIG. 4 is a schematic structural diagram of a second embodiment according to the present disclosure, observed in a planar view.

The structures in the embodiment and the first embodiment are substantially the same, and have the following difference:

As shown in FIG. 4, the first phosphor includes a first fluorescent glue lens 133 and the first fluorescent glue 132. The first substrate 134 is coated with the first fluorescent glue 132, and the lateral part 135 of the first LED chip 131 and the first fluorescent glue 132 are coated with the first fluorescent glue lens 133. The second phosphor includes the second fluorescent glue 152 and a second fluorescent glue lens 153. The second substrate 154 is coated with the second fluorescent glue 152. The lateral part 155 of the second LED chip 151 and the second fluorescent glue 152 are coated with the second fluorescent glue lens 153. Both the first fluorescent glue lens 133 and the second fluorescent glue 153 lens are of spherical structures.

In the embodiment, the first fluorescent glue 132 is sprayed on the top surface of the first LED chip 131. The first fluorescent glue lens 133 is dispensed on the first fluorescent glue 132, and the width of the first fluorescent glue lens 133 is slightly larger than the width of the upper part of the frustum base plate 11. Specifically, the top of the frustum base plate 11 is coated with the first fluorescent glue 132, and the color temperature is 5500 K after white light packaging. The second fluorescent glue 152 is sprayed on the bottom surface and the side surface of the second LED chip 151, the second fluorescent glue lens 153 is dispensed on the second fluorescent glue 152, and the width of the second fluorescent glue lens 153 is slightly greater than that of the second circuit board 14. Specifically, the second circuit board 14 is coated with the second fluorescent glue lens 153, and the color temperature is 6500 K after white light packaging. Through the arrangement of the first fluorescent glue lens 133 and the second fluorescent glue lens 153, the usage amount of fluorescent glue can be saved. Both the first fluorescent glue lens 133 and the second fluorescent glue lens 153 are of spherical structures, so that the total reflection effect of light on an interface between the fluorescent glue and air can be reduced, the light emitting rate of the LED chip is improved, and the illumination effect of the LED vehicle lamp is enhanced.

In the embodiment of the present disclosure, the frustum base plate 11 is made of an aluminum-based anisotropic heat pipe. The taper angle of the frustum base plate 11 is 37.5 degree. The width of the upper bottom surface 111 of the frustum base plate 11 is 1.5 mm larger than that of the circuit board. The radiator 16 is made of a pure aluminum base material.

Embodiment III

Figure 5:
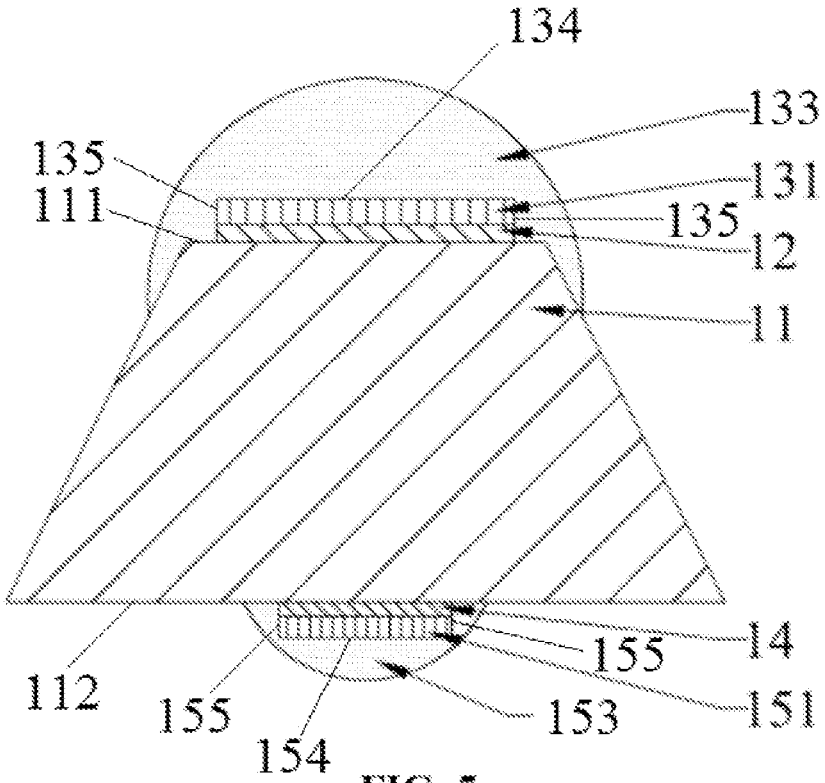
FIG. 5 is a schematic structural diagram of a third embodiment according to the present disclosure, observed in a planar view.

The structures in the embodiment and the first embodiment are substantially the same, and have the following difference:

As shown in FIG. 5, the first phosphor includes the first fluorescent glue lens 133, and the lateral part 135 of the first LED chip 131 and the first substrate 134 are coated with the first fluorescent glue lens 133. The second phosphor includes the second fluorescent glue lens 153. The lateral part 155 of the second LED chip 151 and the second substrate 154 are coated with the second fluorescent glue lens 153. Both the first fluorescent glue lens 133 and the second fluorescent glue lens 153 are of spherical structures.

In the embodiment, the first fluorescent glue lens 133 is sprayed on the top surface of the first LED chip 131, and the width of the first fluorescent glue lens 133 is slightly larger than that of the upper part of the frustum base plate 11. Specifically, the top of the frustum base plate 11 is coated with the first fluorescent glue lens 133, and the color temperature is 5500 K after white light packaging. The second fluorescent glue lens 153 is sprayed on the bottom surface and the side surface of the second LED chip, and the width of the second fluorescent glue lens 153 is slightly larger than that of the second circuit board 14. Specifically, the second circuit board 14 is coated with the second fluorescent glue lens 153, and the color temperature is 6500 K after white light packaging.

Through the arrangement of the first fluorescent glue lens 133 and the second fluorescent glue lens 153, the usage amount of the fluorescent glue can be saved. Both the first fluorescent glue lens 133 and the second fluorescent glue lens 153 are of spherical structures, so that the total reflection effect is reduced, the light emitting rate is improved, the illumination effect of the LED vehicle lamp is enhanced, and the heat of the dispersed fluorescent glue is not easy to concentrate, and the heat dissipation effect is good.

In the embodiment, the frustum base plate 11 is made of a pure silver base material. The taper angle of the frustum base plate 11 is 30 degrees, and the width of the upper bottom surface 111 of the frustum base plate 11 is 2 mm larger than that of the circuit board.

Embodiment IV

Figure 6:
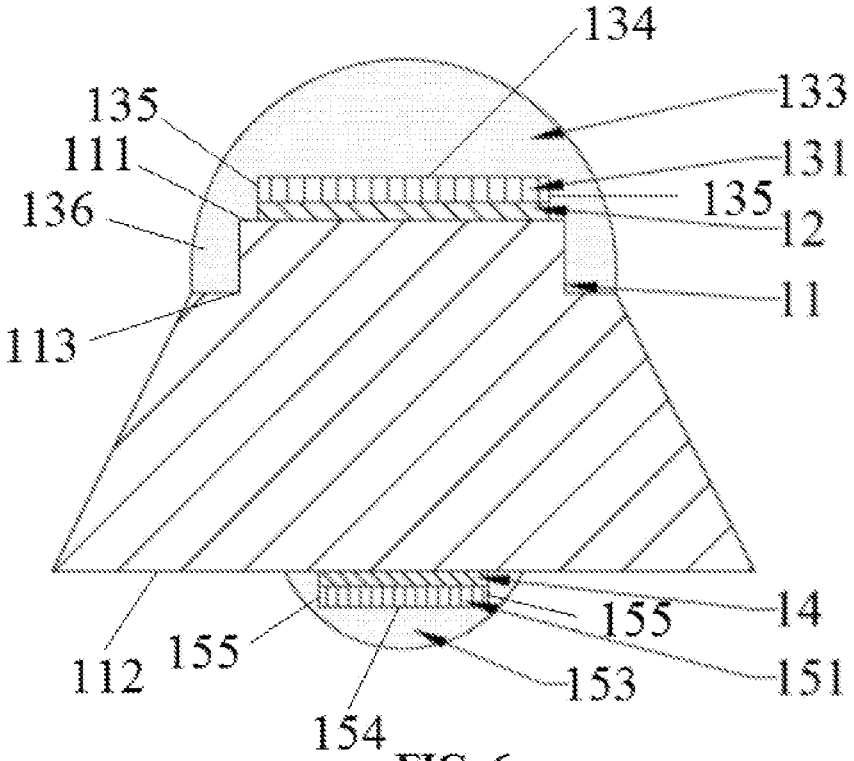
FIG. 6 is a schematic structural diagram of a fourth embodiment according to the present disclosure, observed in a planar view.

The structures in the embodiment and the third embodiment are substantially the same, and have the following difference:

As shown in FIG. 6, a clamping position 113 is arranged on the upper part of the frustum base plate 11, the first fluorescent glue lens 133 is provided with a clamp 136. The clamping position 113 is matched with the clamp 136 to connect the first fluorescent glue lens 133 and the frustum base plate 11.

Through the arrangement of the clamping position 113 and the clamp 136, the connection between the first phosphor and the frustum base plate 11 is more stable, and the first phosphor is not easy to fall off. Specifically, the clamping position 113 on the upper part of the frustum base plate 11 is a step, and the clamp 136 of the first phosphor is clamped on the step.

The above embodiment is the preferable embodiment of the present disclosure but not limit the present disclosure. Any other spirits without deviating from the present disclosure and changes, modifications, replacements, combinations and simplifications made under principles all should be equivalent displacement manners, and are all included in the scope of the present disclosure.

What is claimed is:

1. An LED vehicle lamp with a frustum base plate, comprising a base plate, a circuit board and a plurality of LED chips, wherein the base plate is a frustum base plate, which is arranged on an axis of the LED vehicle lamp, a width of an upper bottom surface of the frustum base plate is smaller than that of a lower bottom surface of the frustum base plate, the lower bottom surface is opposite to the upper bottom surface, an axis of the circuit board is parallel to an axis of the frustum base plate, a width of the circuit board is smaller than that of the upper bottom surface of the frustum base plate, the circuit board is installed on the upper bottom surface of the frustum base plate, and the plurality of LED chips are installed on the circuit board;

wherein the circuit board comprises a first circuit board and a second circuit board, the first circuit board is installed on the upper bottom surface of the frustum base plate, the second circuit board is installed on the lower bottom surface of the frustum base plate, the plurality of LED chips comprise a plurality of first LED chips and a plurality of second LED chips, the plurality of first LED chips are installed on the first circuit board in an inverted mode, a first transparent substrate is arranged on a back of each the first LED chip, a first phosphor is arranged on the first transparent substrate, and the first LED chip and the first transparent substrate are coated with the first phosphor; the plurality of second LED chips are installed on the second circuit board in an inverted mode, a second transparent substrate is arranged on a back of each the second LED chip, a second phosphor is arranged on the second transparent substrate, and the second LED chip and the second transparent substrate are coated with the second phosphor;

wherein the first phosphor comprises a first fluorescent glue lens, and lateral parts of the first LED chip and the first transparent substrate are coated with the first fluorescent glue lens; the second phosphor comprises a second fluorescent glue lens, lateral parts of the second LED chip and the second transparent substrate are coated with the second fluorescent glue lens, both the first fluorescent glue lens and the second fluorescent glue lens are of spherical structures; and wherein a clamping position is arranged on an upper part of the frustum base plate, the first fluorescent glue lens is provided with a clamp, and the clamping position is matched with the clamp to connect the first fluorescent glue lens and the frustum base plate.

2. The LED vehicle lamp with the frustum base plate according to claim 1, wherein an included angle alpha between a side surface of the frustum base plate and the lower bottom surface of the frustum base plate is larger than or equal to 25 degrees and smaller than or equal to 75 degrees.

3. The LED vehicle lamp with the frustum base plate according to claim 1, wherein the frustum base plate is made of a high-thermal-conductivity base material.

4. The LED vehicle lamp with the frustum base plate according to claim 1, wherein the axis of the frustum base plate coincides with the axis of the LED vehicle lamp, and the plurality of LED chips are installed on the circuit board in a single row.

5. The LED vehicle lamp with the frustum base plate according to claim 1, wherein one end of the frustum base plate is connected with a radiator.

6. The LED vehicle lamp with the frustum base plate according to claim 2, wherein one end of the frustum base plate is connected with a radiator.

7. The LED vehicle lamp with the frustum base plate according to claim 3, wherein one end of the frustum base plate is connected with a radiator.

8. The LED vehicle lamp with the frustum base plate according to claim 4, wherein one end of the frustum base plate is connected with a radiator.

* * * * *